US005947463A

United States Patent [19]

Honegger

[11] Patent Number: 5,947,463

[45] **Date of Patent: *Sep. 7, 1999**

[54] METHOD AND APPARATUS OF STORING SHEET-LIKE PRODUCTS ON ROLLS

[75] Inventor: Werner Honegger, Bach, Switzerland

[73] Assignee: Ferag AG, Hinwil, Switzerland

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/592,198

[22] Filed: Jan. 26, 1996

[30] Foreign Application Priority Data

Jan. 31, 1995 [CH] Switzerland ..... 00255/95

[51] Int. Cl.[6] ..... B65H 5/22

[52] U.S. Cl. ..... 271/3.01; 271/9.12; 271/151; 271/161; 271/299; 271/209; 242/528; 53/118

[58] Field of Search ..... 271/3.01, 207, 271/209, 198, 200–201, 299, 9.12, 216, 151, 161; 242/528; 148/347.01–347.04; 53/118

[56] References Cited

U.S. PATENT DOCUMENTS

| | | | |
|---|---|---|---|
| 3,951,399 | 4/1976 | Reist | 271/299 X |
| 4,525,982 | 7/1985 | Meier . | |
| 4,575,988 | 3/1986 | Meier . | |
| 4,580,737 | 4/1986 | Linder | 242/528 |
| 4,582,272 | 4/1986 | Reist . | |
| 4,676,496 | 6/1987 | Honegger | 271/3.01 X |
| 4,697,400 | 10/1987 | Gerber . | |
| 4,866,910 | 9/1989 | Reist . | |
| 4,903,908 | 2/1990 | Hansch | 242/528 |
| 5,004,092 | 4/1991 | Meier . | |
| 5,074,398 | 12/1991 | Meier . | |

FOREIGN PATENT DOCUMENTS

| | | | |
|---|---|---|---|
| 0 229 888 | 7/1987 | European Pat. Off. . | |
| 236561 | 9/1987 | European Pat. Off. | 271/207 |
| 0 272 398 | 6/1988 | European Pat. Off. . | |
| 0 329 602 | 8/1989 | European Pat. Off. . | |
| 0 677 470 | 10/1995 | European Pat. Off. . | |
| 2 140 785 | 12/1984 | United Kingdom . | |
| 2 248 829 | 4/1992 | United Kingdom . | |

*Primary Examiner*—Boris Milef
*Attorney, Agent, or Firm*—Brinks Hofer Gilson & Lione

[57] ABSTRACT

A method for storing sheet-like products comprising the steps of providing a continuous stream of products, winding up a first and a further section of the products to form a first and a further roll, respectively, and unwinding the products from the first and the further roll, simultaneously. In this arrangement, the products are wound up on the two rolls with the same orientation and also unwound from the two rolls with the same orientation.

28 Claims, 5 Drawing Sheets a)
43
41
45
44
41
42
46
b)
47
45
42
46
c1)
45
46
45
c2)
46'
d)
45
48
46
e)
45
48
46

METHOD AND APPARATUS OF STORING SHEET-LIKE PRODUCTS ON ROLLS

BACKGROUND OF THE INVENTION

The present invention relates to a method of storing sheet-like products, in particular printed products such as newspapers, periodicals and the like. The sheet-like products are provided in a continuous stream, preferably in an imbricated formation. In the method of the present invention, a first section of the products is wound up to form a first roll and at least one further section of the products is wound up to form a further roll assigned to the first roll. In addition, the first section of the product is unwound from the first roll and the further section of the products is unwound from the further roll. The present invention also relates to an apparatus for implementing such a method.

An example of a method related to the present invention is described in EP-A-0 677 470. In that patent, a continuous imbricated stream of sheet-like products is first of all fed to an intermediate roll. As soon as the intermediate roll is fully wound, the continuous imbricated stream is directed to a main roll. Simultaneously, the products stored on the intermediate roll are unwound again from the intermediate roll and fed to a second main roll assigned to the first main roll. The two main rolls are thus wound simultaneously, one main roll-being supplied directly by the continuous imbricated stream and the other main roll being supplied by the intermediate roll.

Furthermore, according to the known method, during simultaneous unwinding of the products from the two main rolls, the product stream coming from one main roll is guided away directly for further processing. On the other hand, the product stream coming from the second main roll once again passes onto the intermediate roll and then, after the two main rolls are fully unwound, the product stream passes from the intermediate roll for the purpose of further processing.

The disadvantage with this known method is that some of the products have to be guided via the intermediate roll both during winding up and during unwinding. The intermediate storage of the products on the intermediate roll basically always gives rise to a change in orientation of the products. In other words, if the intermediate roll is fed products in the form of an imbricated stream with the back leading, then the products, during unwinding from the intermediate roll, are oriented such that the back is now trailing.

This, in turn, disadvantageously results in the products always being stored on the two main rolls with different orientation. As a result, identical orientation of all the products guided away from the main rolls during unwinding has to be produced again by further intermediate storage of the products on an intermediate roll.

An object of the present invention is to develop a method that overcomes the disadvantages of the prior art method by achieving simplified winding up and unwinding of the products while using a plurality of mutually assigned rolls.

SUMMARY OF THE INVENTION

The object of the present invention is achieved by winding up the products onto all the rolls with the same orientation and also unwinding the products from all the rolls with the same orientation.

According to the invention, all the products are therefore fed to the rolls without an intermediate roll being provided upstream and all the products are guided away from the rolls during unwinding without an intermediate roll being provided downstream. By eliminating the upstream and downstream intermediate rolls, the disadvantageous change in orientation, known from the prior art, of some of the products during winding up and unwinding is avoided. Nevertheless, it still remains possible to wind up some of the products onto a first roll and further products onto further rolls. The use of a plurality of mutually assigned rolls advantageously gives rise to smaller roll diameters that can be handled more easily during transportation and intermediate storage of rolls wound with products.

In the method of the present invention, an incoming product stream fed to the rolls is divided up into two or more sub-formations. These two or more sub-formations are then simultaneously fed to mutually assigned rolls.

In another embodiment, it is also possible, however, to feed an incoming product stream first to a buffer store that does not effect a change in orientation of the products, and second, simultaneously with the product stream coming from the buffer store, to mutually assigned rolls during the subsequent emptying of the buffer store. In this case, a diverter provided upstream of the rolls only has to be changed over once, during winding of the mutually assigned rolls, if the incoming product stream is to be fed directly to the rolls after the buffer store has been filled. Constant changing over of the diverter, as is necessary in the above-described division of the product stream in sections onto the mutually assigned rolls, can be dispensed with for this variance of the method.

Finally, in another embodiment, it is also possible to wind the individual rolls individually at various locations and/or times and then to assign them to one another, or connect them to one another, at a later point in time for the purpose of unwinding.

According to the present invention, during the unwinding, the products are stored on mutually assigned rolls. The product stream coming from one roll can be guided away directly from the rolls for the purpose of further processing, while the product stream or streams coming from further rolls may be fed first to an intermediate buffer that does not effect a change in orientation of the products and from which the products can then pass for the purpose of further processing.

It is also possible to guide away directly a plurality of, or all of, the product streams coming from the further rolls for the purpose of further processing. In particular, simultaneous charging of a plurality of processing sections is also possible.

Furthermore, it is possible to use a device of corresponding design to combine the product streams running away from mutually assigned rolls during the unwinding of the products, and to form a single product stream that can then be further processed.

Finally, it is also possible to separate the mutually assigned rolls before unwinding and/or to do away with the assignment of rolls established during winding up. This allows the products stored on the individual rolls to be processed further in a manner separated in terms of location and/or time.

According to the invention, the individual mutually assigned rolls can thus be charged and/or emptied, simultaneously or at different times.

BRIEF DESCRIPTION OF THE DRAWINGS

The present invention will now be explained in more detail below, with reference to the drawings.

DETAILED DESCRIPTION

Figure 1:
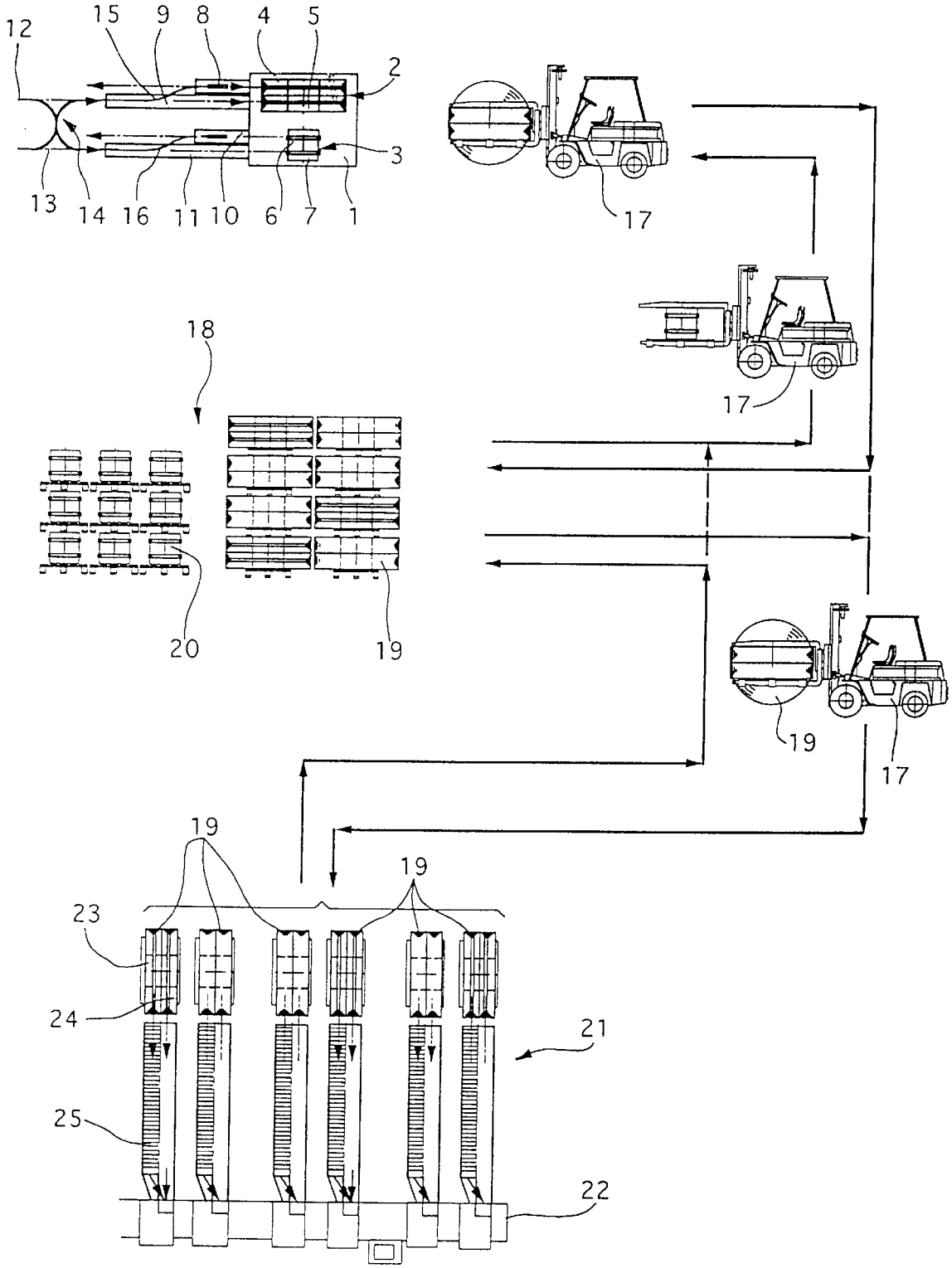
FIG. 1 shows an operational chart illustrating the principle of a method according to the present invention.

The operational chart according to FIG. 1 shows a winding-up station 1 in which altogether four rolls are mounted, with two rolls being assigned to one another. Each of the two mutually assigned rolls thus forms a first and a second double roll 2, 3. The first and second double rolls 2, 3 each comprise the individual rolls 4, 5 and 6, 7, respectively.

In each case, one conveying section 8, 9, 10, 11 is assigned to each roll 4, 5, 6, 7 respectively. The conveying sections 8, 9 serve, in this arrangement, to charge the first double roll 2, while the conveying sections 10, 11 serve to charge the second double roll 3.

The winding-up station 1 can be charged by two different feed sections 12, 13 that are connected to one another by a changeover diverter 14. It is, however, also conceivable to provide only one feed section 12 or 13 that can be connected by a diverter to either of the conveying sections 8, 9 or 10, 11.

Two further diverters 15, 16 are provided downstream of the changeover diverter 14. As a result, the conveying sections 8, 9, 10, 11 can be charged with products simultaneously in each case.

The winding-up station 1 can be operated in the following manner. First a product stream arriving, for example, in an imbricated formation, from the feed section 12, is directed past the changeover diverter 14 to the diverter 15. The diverter 15 divides the product stream up into two sub-streams that are simultaneously fed to the assigned rolls 4, 5. As a result, the rolls are fully wound with products that are each oriented in the same way in the sub-streams.

As soon as the two mutually assigned rolls 4, 5 or the first double roll 2 is/are fully wound, the changeover diverter 14 is changed over. As a result, the product stream arriving by way of the feed section 12 is then divided up into two similar sub-streams by the diverter 16. The two sub-streams are then simultaneously fed to the conveying sections 10, 11, and thus to the two mutually assigned rolls 6, 7.

During the winding of the rolls 6, 7, the already fully wound first double roll 2 is removed from the winding-up station by a transporting vehicle 17 and transported to an intermediate store 18. At the intermediate store 18, the corresponding receiving position of the winding-up station 1 can be taken by two new, mutually assigned winding cores. The exchange of the full first double roll 2 for two empty, mutually assigned winding cores can take place while the second double roll 3 is charged by the conveying sections 10, 11. By providing first and second double rolls 2, 3 that can be charged alternately, there is sufficient time for the exchange of a full double roll for two empty winding cores.

Since, during charging of the first or second double roll 2, 3, the incoming product stream is split up into the two individual rolls 4, 5 or 6, 7, respectively, the first or second double roll 2, 3 is advantageously driven at half the speed that an individual roll not assigned to a further roll would have to be driven.

The transporting vehicle 17 is used for the removal and the transportation of full rolls to the intermediate store 18 and for the transportation of empty winding cores from the intermediate store 18 to the winding-up station 1. Full double rolls 19 as well as empty double winding cores 20 are stored intermediately in the intermediate store 18.

From the intermediate store 18, the full double rolls 19 are transported, by the transporting vehicle 17, to a further-processing station 21. The full double rolls 19 may also be fed directly from the winding-up station 1 to the further-processing station 21. In addition the further-processing station 21 may include, for example, a collecting section 22, that can be charged in parallel with products stored on various double rolls 19.

In the embodiment shown in FIG. 1, the products stored on the two rolls 23, 24 of the double roll 19 are unwound simultaneously and the products from the roll 24 pass directly to the collecting section 22. The simultaneously unwound products from the roll 23, however, are first fed to an intermediate store 25 that does not change the orientation of the products within the product formation. After the double roll 19, comprising the two mutually assigned rolls 23, 24, is fully unwound, the collecting section 22 can no longer be fed by the roll 24. At this point, the emptying of the intermediate store 25 begins and the product stream coming from the intermediate store 25 adjoins, in an uninterrupted manner, the end of the product stream coming from the roll 24. As a result, continuous charging of the collecting section 22 is ensured.

Figure 2:
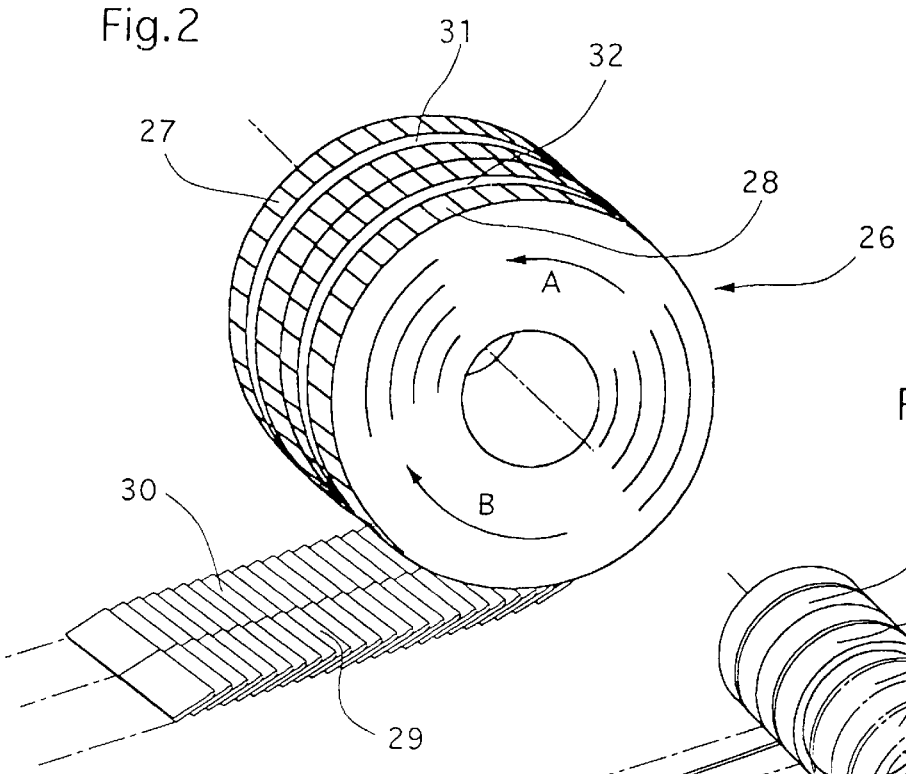
FIG. 2 shows a unit, comprising two rolls, that can be used in the method of the present invention.

FIG. 2 shows a double roll 26 that can be used, for example, in the operation shown in FIG. 1. The double roll 26 comprises two individual, mutually assigned rolls 27, 28. In this arrangement, the two rolls 27, 28 may be connected releasably or fixedly to one another to form the double roll 26.

Two parallel product streams 29, 30 can be wound up onto the double roll 26. The product streams 29, 30 each comprise products which are oriented in the same way, are provided in imbricated formation, and have a leading edge located on top (folded edge or open side edge).

During winding up of the product streams 29, 30, the double roll 26 is driven in the direction of the arrow A. Correspondingly, the double roll 26 is driven in the direction of the arrow B during unwinding. In addition, the products are retained on the double roll 26 by two winding bands 31, 32. The winding bands 31, 32 are each assigned to a roll 27, 28, respectively.

Figure 3:
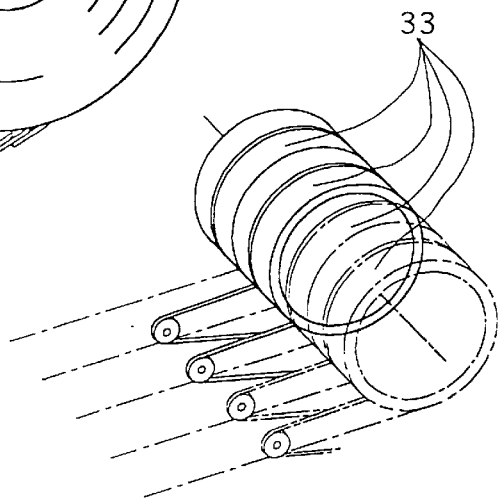
FIG. 3 shows a unit, comprising four rolls, that can be used in the method of the present invention.

As shown in FIG. 3, it is not only possible to assign two rolls to one another, but also to assign, for example, four rolls 33 to one another. This can be carried out by connecting two of the double rolls shown in FIG. 2.

When using four mutually assigned rolls 33, all that is necessary, for example in an arrangement according to FIG. 1, is for the corresponding number of diverters 15, 16 and intermediate stores 25 to be provided for each unit of the combined roll 33.

Figure 4:
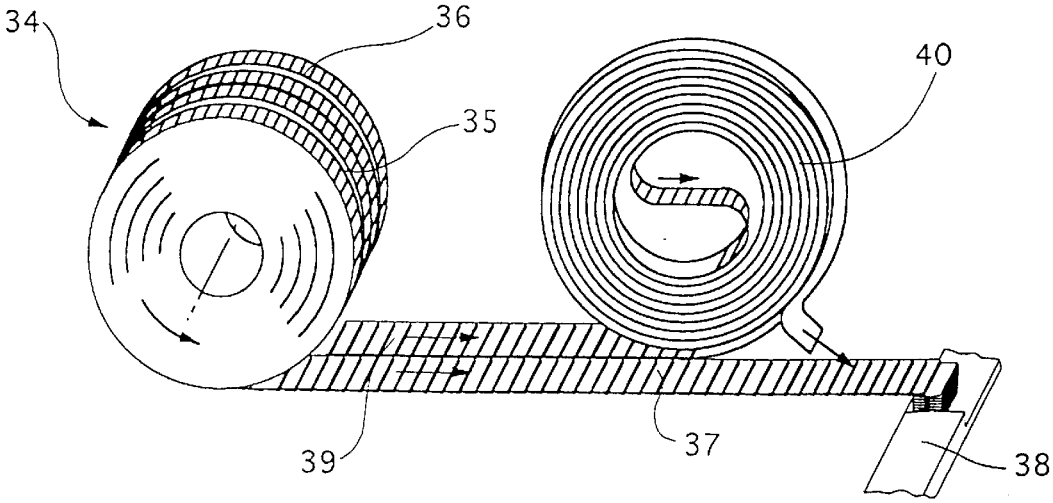
FIG. 4 shows a unit, comprising two rolls, that is coupled to a downstream intermediate store and can be used in the method of the present invention.

FIG. 4 shows an unwinding unit that operates according to the present invention and in which products are wound and unwound from a double roll 34, and guided away from the double roll in parallel. In this arrangement, the double roll 34 is formed by the two mutually assigned rolls 35, 36.

A product stream 37 coming from the roll 35 is fed directly to a further-processing station 38, while a product stream 39 coming from the roll 36 is first directed to an intermediate store 40. The intermediate store 40 includes a double-spiral storage path in which the orientation of the products is not changed. For example, if products with a leading folded edge located on the top are fed to the intermediate store 40, then the products are also discharged from the intermediate store 40 with a leading folding edge located on the top. The products first pass, on a spiral path into the center of the intermediate store 40. Next, the products pass on a further, second spiral path running between the first spiral path, outwards again from the center, where they are discharged from the intermediate store 40. The intermediate store 40 may be designed, for example, corresponding to Swiss Patent Application No. 00 009/95.

In order to ensure that the method according to the present invention runs correctly at an unwinding station according to FIG. 4, the capacity of the intermediate store 40 has to correspond at least to the capacity of a roll 35 or 36. As a result, all the products stored on a roll 35, 36 are capable of being deposited simultaneously in the intermediate store 40.

By a corresponding activation of the intermediate store 40, it is possible to supply the further-processing station 38 with a continuous product stream. This is possible when the beginning of the product stream supplied by the intermediate store 40 to the further-processing station 38 adjoins, in an uninterrupted manner, the end of the product stream supplied by the roll 35.

Figure 5:
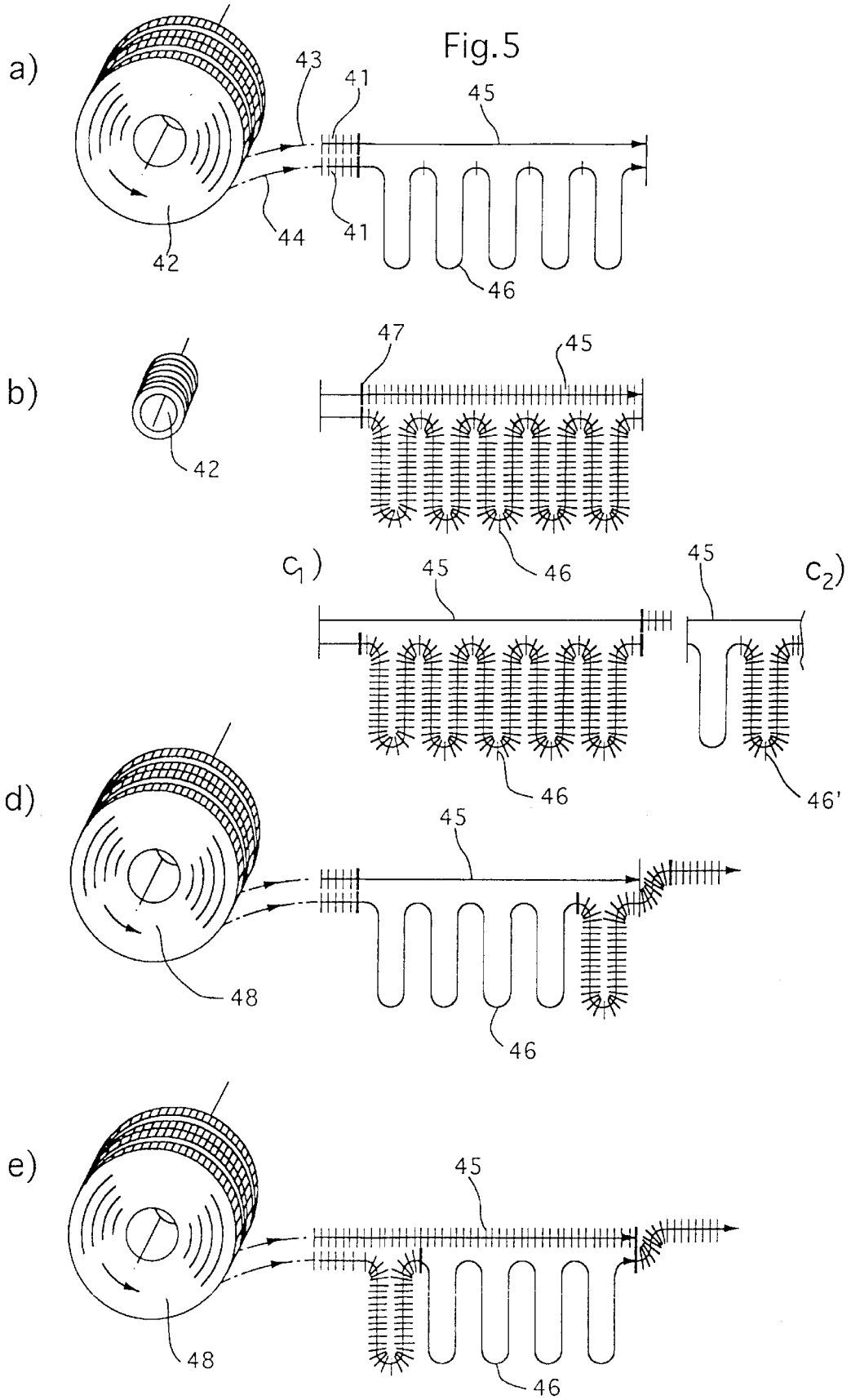
FIGS. 5*a*–5*e* show various operating phases of an apparatus for implementing the method of the present invention, during the operation of unwinding the products from the mutually assigned rolls.

FIG. 5 illustrates a further possible method, according to the present invention, of unwinding products 41 from a double roll 42. The double roll 42 is driven in the arrow direction and supplies two mutually parallel product streams 43, 44. The product stream 43 passes for further processing in the arrow direction by way of the path section 45. The product stream 44 is fed to a meandering intermediate store 46 that includes a storage path running in a five-loop line. The length of the storage path of the intermediate store 46 is dimensioned such that the intermediate store 46 is fully filled precisely when it has received all the products stored on a roll of the double roll 42.

The operating position shown in FIG. 5*a* illustrates that both the path section 45 and the intermediate store 46 are charged simultaneously with products 41 by the product streams 43, 44. Therefore, as soon as the first product 41 passes from the double roll 42 into the path section 45, the intermediate store 46 also receives the first product 41.

FIG. 5*b* shows the operating position in which the double roll 42 is fully unwound. The end of the two product streams 43, 44 comes from the double roll 42 and is identified in FIG. 5*b* by 47. Consequently, it can be seen from FIG. 5*b* that the respective last products 47 of the product stream 43, 44 simultaneously reach the path section 45 and the intermediate store 46. In the operating state shown in FIG. 5*b*, both the path section 45 and the intermediate store 46 are fully filled with products 41.

In this operating state, the advancement means of the intermediate store 46 is stopped and the intermediate store 46 further remains fully filled. At this operating state, none of the products 41 contained in the intermediate store 46 are discharged from the intermediate store 46. The path section 45, however, continues to be advanced, and, since there are no more products supplied from the double roll 42, the path section 45 is emptied.

FIG. 5$c_1$ shows the operating state after the path section 45 has been completely emptied. At the point in time illustrated in FIG. 5$c_1$, the advancement of the intermediate store 46 is set in operation again. As a result, the first product stored in the intermediate store 46 is discharged directly after the last product has left the path section 45. During the subsequent emptying of the intermediate store 46, the empty winding core 42 can be exchanged for a new, full double roll 48.

FIG. 5$c_2$ illustrates an alternative mode of operation of the unwinding method according to the present invention. In this mode of operation, the capacity of an intermediate store 46' is dimensioned such that all the products stored on one roll of the double roll 42 and the number of products that can be stored in the path section 45, can be simultaneously retained in the intermediate store 46'.

Since the intermediate store 46' is not yet completely filled when the last product passes into the path section 45, it is not necessary to stop the advancement of the intermediate store 46' in the operating position shown in FIG. 5*b*. During the emptying of the path section 45, the products located in the intermediate store 46' continue to be transported on the meandering storage path of the intermediate store 46'. The first product leaving the intermediate store 46' then adjoins in an uninterrupted manner the end of the product stream running away from the path section 45, without the advancement of the intermediate store 46' having to be brought to a standstill beforehand.

FIG. 5*d* shows that further charging of the path section 45 and intermediate store 46 by a new double roll 48 has to start when a number of products are stored in the intermediate store 46. The number of products that are stored in the intermediate store 46 corresponds to the maximum number of products that can be stored in the path section 45. This ensures that the first product conveyed from the double roll 48 by way of the path section 45, adjoins in an uninterrupted manner the last product discharged from the intermediate store 46. As a result, a continuous product stream can ultimately be achieved.

FIG. 5*e* illustrates the last-mentioned operation of the product stream delivered from the double roll 48. In FIG. 5*e*, the path section 45 adjoins in an uninterrupted manner the end of the product stream from the intermediate store 46.

Figure 6:
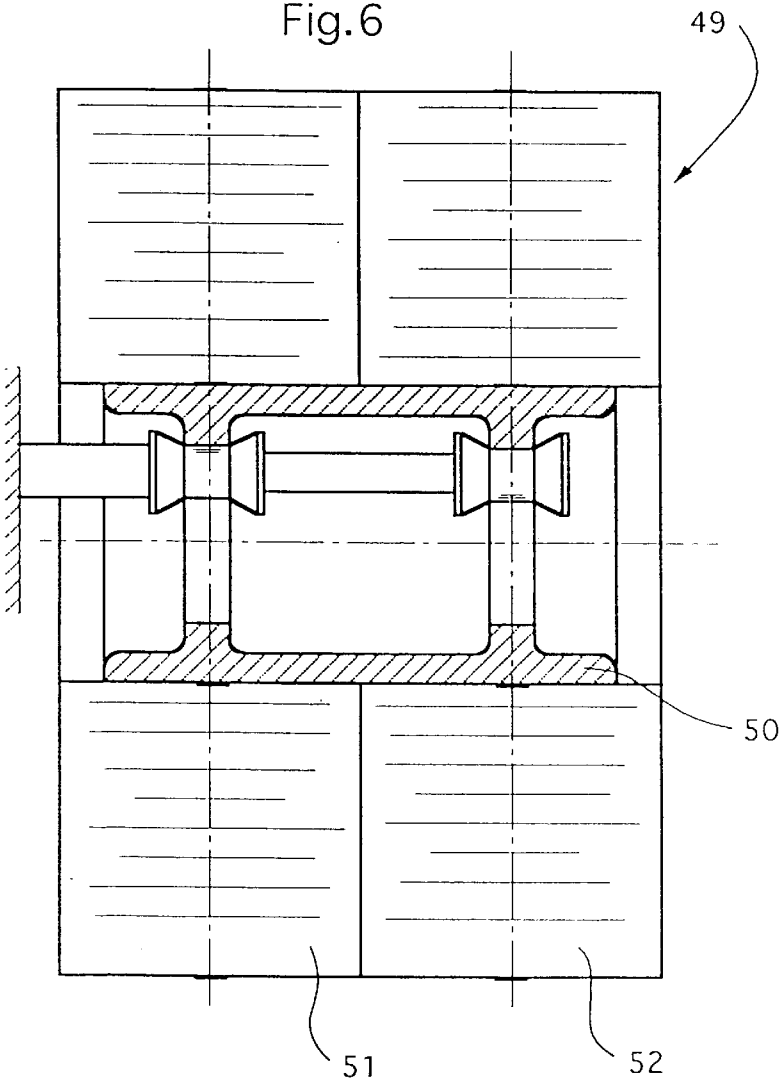
FIG. 6 shows a cross-sectional view of a unit comprising two mutually assigned rolls that are fixedly connected to one another.

FIG. 6 shows a section through a double roll 49 that can be used according to the present invention and is mounted on one side. The winding core 50 of the two rolls 51, 52 forming the double roll 49 is, according to FIG. 6, designed in one piece. Thus, the two rolls 51, 52 are fixedly and non-releasably connected to one another.

Figure 7:
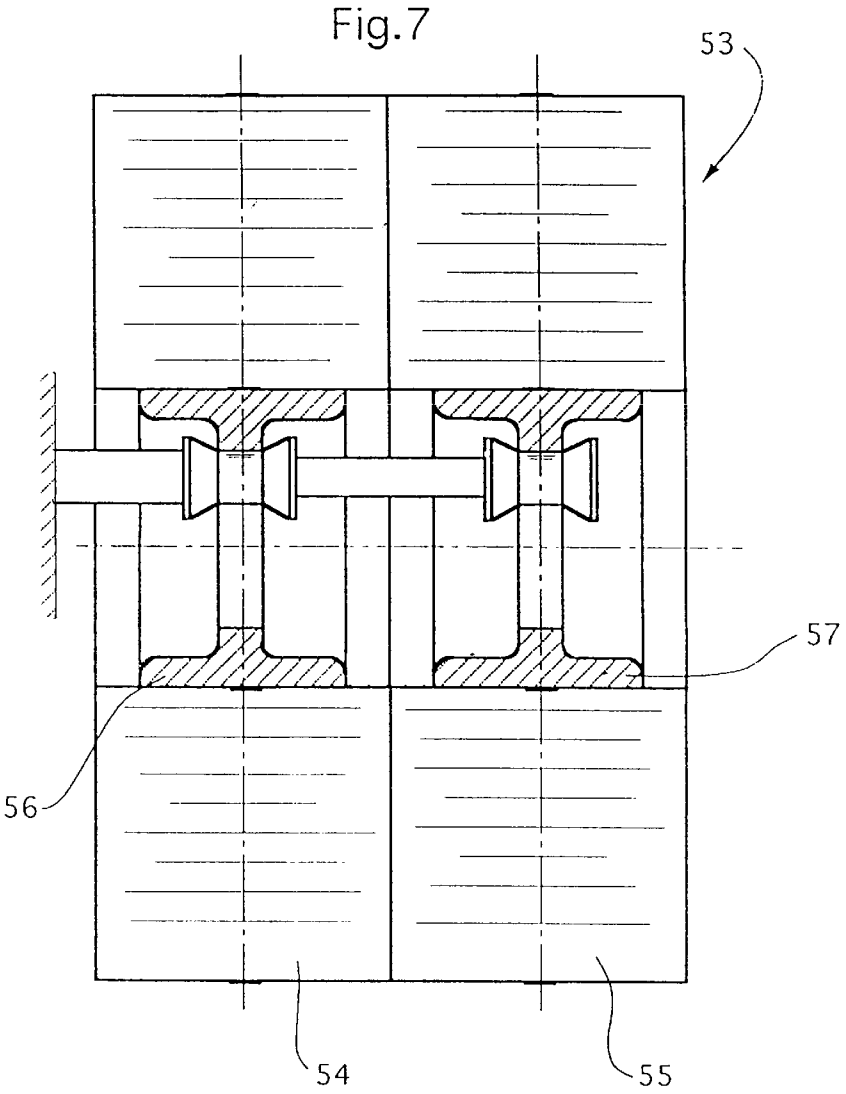
FIG. 7 shows a cross-sectional view of a unit comprising two mutually assigned rolls that are releasably connected to one another.

FIG. 7 shows a double roll 53 in which each of the two rolls 54, 55 forming the double roll 53 is assigned an individual winding core 56, 57, respectively. On account of the provision of the two separate winding cores 56, 57, the individual rolls 54, 55 can be released from one another for the purpose of winding up or unwinding.

Figure 8:
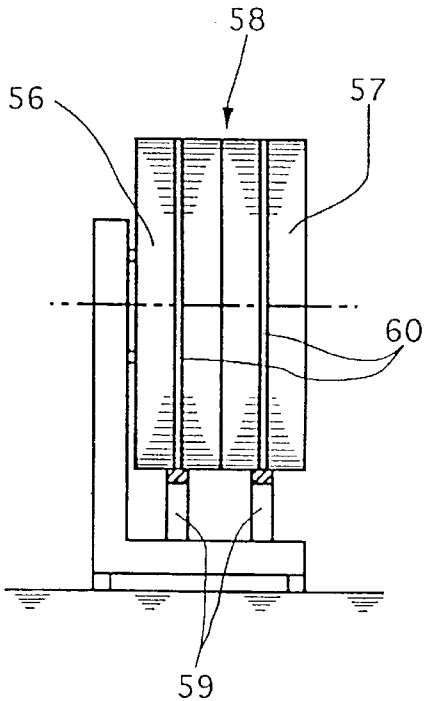
FIG. 8 shows a first embodiment of a module that can be used in the method of the present invention and has two mutually assigned rolls.

FIG. 8 shows a double module 58 that can be used according to the present invention. The double module 58 is mounted on one side and comprises two rolls 56, 57. The double module 58 is also provided with two bearing blocks 59 on which the rolls 56, 57 are set down, i.e. supported, during transportation. As a result, the winding bands 60 of the two rolls 56, 57 are fixed during the transportation, thus avoiding undesired loosening of the winding bands 60 from the rolls 56, 57. For the purpose of unwinding the products from the rolls 56, 57, the rolls are then raised off from the bearing blocks 59 again in order to permit free rotation of the rolls 56, 57. The construction and mode of functioning are similar to the apparatus described in Swiss Patent Application No. 03 969/94.

Figure 9:
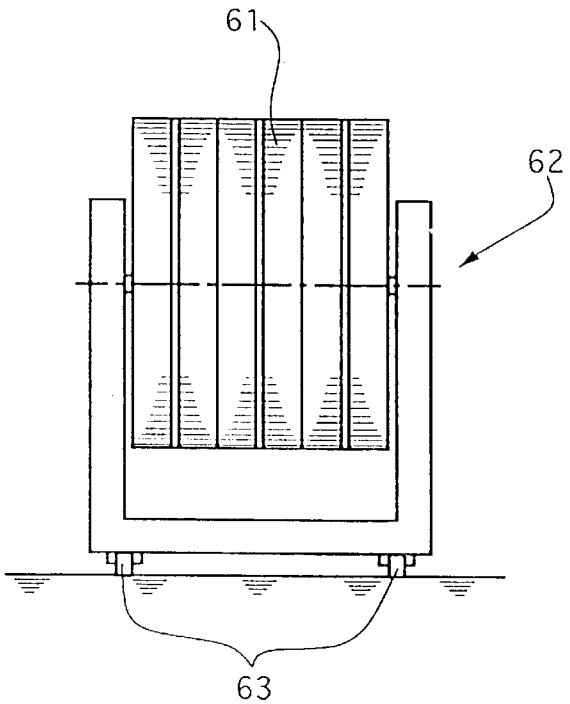
FIG. 9 shows a second embodiment of a module that can be used in the method of the present invention and has three mutually assigned rolls.

FIG. 9 shows a module 62 that contains a triple roll 61 that is mounted on two sides. The module 62 is provided with castors 63, so that it can be displaced for the purpose of transportation.

Figure 10:
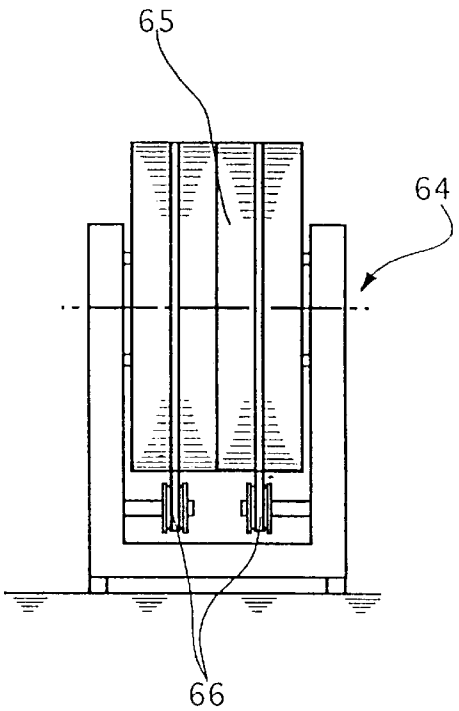
FIG. 10 shows a third embodiment of a module that can be used in the method of the present invention and has two mutually assigned rolls.

Finally, FIG. 10 shows a double roll 65 that is mounted on both sides in a module 64. Band reels 66 for receiving the respective winding bands 60 of the individual rolls are additionally integrated in the module 64.

The modules for receiving the rolls which can be operated according to the invention may also be differently designed. Preferably, the features of the modules according to FIGS. 8–10 can be combined with one another as required.

Those skilled in the art to which the invention pertains may make modifications and other embodiments employing the principles of this invention without departing from its spirit or essential characteristics, particularly upon considering the foregoing teachings. The described embodiments are to be considered in all respects only as illustrative and not restrictive and the scope of the invention is, therefore, indicated by the appended claims rather than by the foregoing description. Consequently, while the invention has been described with reference to particular embodiments, modifications of structure, sequence, materials and the like would be apparent to those skilled in the art, yet still fall within the scope of the invention.

I claim:

1. A method for storing sheet-like products, the method comprising the steps of:

providing sheet-like products in a continuous stream with a plurality of sections;

winding up a first section of the sheet-like products to form a first roll, the first roll including a first winding core;

winding up at least one further section of the sheet-like products to form a further roll assigned to the first roll, the further roll including a second winding core connected and coaxially arranged next to the first winding core, the at least one further section of sheet-like products being wound up on the further roll in the same orientation as the first section of sheet-like products is wound up on the first roll; and driving synchronously the first and further rolls with a common drive.

2. The method according to claim 1 comprising dividing up the continuous stream of sheet-like products into two similar sub-streams and simultaneously feeding the sub-streams to the first and further rolls.

3. The method according to claim 1 wherein the first and second winding cores are releasably connected to one another.

4. The method according to claim 1 wherein the first and second winding cores are non-releasably connected to one another.

5. The method according to claim 1 further comprising the steps of:

guiding away the sheet-like products stored on the first roll in a continuous stream for the purpose of further processing;

feeding, simultaneously with the guiding away of the sheet-like products stored on the first roll, the sheet-like products stored on the further roll to at least one intermediate store; and guiding away the sheet-like products stored on the at least one intermediate store after the first roll has been fully unwound, for the purpose of further processing.

6. The method according to claim 5 wherein the intermediate store discharges the intermediately stored products with the same orientation as that with which they were fed to the intermediate store.

7. The method according to claim 5 wherein a beginning of the continuous product stream guided away from the intermediate store adjoins in an uninterrupted manner an end of the product stream guided away from the first roll.

8. The method according to claim 5 further comprising the steps of exchanging a first unit after the first unit including the first roll and the further roll has been fully unwound and during the removal of the intermediately stored products coming from the intermediate store, for a fully wound further unit of mutually assigned rolls, and adjoining in an uninterrupted manner a beginning of the product stream guided away from the further unit with an end of the product stream coming from the intermediate store.

9. An apparatus for processing sheet-like products in a continuous stream comprising:

a rotatable drivable first roll including a first winding core;

at least one further roll assigned to and synchronously rotatably drivable with the first roll, the at least one further roll including a second winding core, the second winding core being arranged coaxially next to the first winding core, the second winding core also being connected to the first winding core; and a removing device for guiding the sheet-like products away from the first roll and the at least one further roll in the same orientation, the removing device having at least two path sections for simultaneously guiding sheet-like product streams away from the first roll and the at least one further roll.

10. The apparatus according to claim 9 further comprising means for simultaneously forming a main continuous stream of sheet-like products from the sheet-like product streams being guided away from the first roll and the at least one further roll.

11. The apparatus according to claim 10 further comprising two unwinding stations, wherein said first and further rolls are provided at each unwinding station and are simultaneously unwound at each unwinding station.

12. The apparatus according to claim 9 further comprising at least one intermediate store provided downstream of the first roll and the at least one further roll, the at least one intermediate store having a capacity that corresponds to the capacity of the further roll.

13. The apparatus according to claim 9 further comprising at least one intermediate store provided downstream of the first roll and the at least one further roll, and wherein the at least one intermediate store includes one of a linear, a meandering, and a double-spiral storage path.

14. The apparatus according to claim 9 wherein the first and second winding cores are non-releasably connected to one another other.

15. The apparatus according to claim 9 wherein the first and second winding cores are releasably connected to one another other.

16. A winding apparatus for winding-up sheet-like products arriving in a continuous stream comprising:

a rotatably drivable first roll including a first winding core;

at least one further roll assigned to and synchronously rotatably drivable with the first roll, the at least one further roll including a second winding core, the second winding core being arranged coaxially next to the first winding core, the second winding core also being connected to the first winding core; and a conveying device for feeding the sheet-like products in the same orientation and in a continuous stream to the first roll and to the at least one further roll, the conveying device having at least two conveying sections for simultaneously feeding product streams to the first roll and the at least one further roll, the products within the product stream fed to the first roll being oriented in the same manner as the products within the product stream fed to the at least one further roll, the product streams being simultaneously wound-up on the first roll and the at least one further roll.

17. The winding apparatus of claim 16 further comprising:

a feed section for feeding a single continuous stream of sheet-like products, the feed section being arranged upstream of the at least two conveying sections; and a diverter arranged between the feed section and the at least two conveying sections for simultaneously forming at least two sheet-like product streams from the single continuous stream of sheet-like products and for diverting each of the two sheet-like product streams to one of the at least two conveying sections.

18. The winding apparatus of claim 17 further comprising:

two winding stations arranged side by side, each winding station being provided with said first and further rolls, said first and further rolls at each winding station being simultaneously formed.

19. The winding apparatus of claim 16 further comprising:

two winding stations arranged side by side, each winding station being provided with said first and further rolls, said first and further rolls at each winding station being simultaneously formed.

20. The winding apparatus of claim 16 wherein the first and second winding cores are non-releasably connected to one another other.

21. The winding apparatus of claim 16 wherein the first and second winding cores are releasably connected to one another other.

22. A method for processing sheet-like products, the method comprising the steps of:

unwinding a first section of sheet-like products from a first roll, the first roll including a first winding core;

unwinding at least one further section of sheet-like products from at least one further roll assigned to the first roll, the further roll including a second winding core connected and coaxially arranged next to the first winding core, the at least one further section of sheet-like products being unwound from the at least one further roll in the same orientation as the first section of sheet-like products is unwound from the first roll; and driving synchronously the first and further rolls with a common drive.

23. The method according to claim 22 wherein the first and second winding cores are releasably connected to one another.

24. The method according to claim 22 wherein the first and second winding cores are non-releasably connected to one another.

25. The method according to claim 22 further comprising the steps of:

guiding away the sheet-like products stored on the first roll in a continuous stream for the purpose of further processing;

feeding, simultaneously with the guiding away of the sheet-like products stored on the first roll, the sheet-like products stored on the at least one further roll to at least one intermediate store; and guiding away the sheet-like products stored on the at least one intermediate store after the first roll has been fully unwound, for the purpose of further processing.

26. The method according to claim 25 wherein the at least one intermediate store discharges the intermediately stored sheet-like products with the same orientation as that with which they were fed to the at least one intermediate store.

27. The method according to claim 25 wherein a beginning of the continuous product stream guided away from the at least one intermediate store adjoins in an uninterrupted manner an end of the product stream guided away from the first roll.

28. The method according to claim 25 further comprising the steps of exchanging a first unit including the first roll and the at least one further roll after the first unit has been fully unwound and during the removal of the intermediately stored products coming from the at least one intermediate store, for a further unit including at least two mutually assigned and fully wound rolls, and adjoining in an uninterrupted manner a beginning of a product stream guided away from the further unit with an end of the product stream coming from the at least one intermediate store.

* * * * *

UNITED STATES PATENT AND TRADEMARK OFFICE

CERTIFICATE OF CORRECTION

PATENT NO. : 5,947,463

DATED : September 7, 1999

INVENTOR(S) : Honegger

It is certified that error appears in the above-identified patent and that said Letters Patent is hereby corrected as shown below:

Claim 8, Col. 8, lines 25-26, change "after the first unit including the first roll and the further roll" to -- including the first roll and the further roll after the first unit --.

Under "Foreign Application Priority Data," change the priority document Number from "00255/95" to -- 00255/95-9 --.

Signed and Sealed this

Second Day of May, 2000

*Attest:*

*Attesting Officer*

Q. TODD DICKINSON

*Director of Patents and Trademarks*